US006058523A

United States Patent [19]

Sleboda

[11] Patent Number: 6,058,523

[45] Date of Patent: May 9, 2000

[54] INSULATED BED BATH CONSTRUCTION

[76] Inventor: Renee Sleboda, 951 Taylor Ave., Scranton, Pa. 18510

[21] Appl. No.: 09/349,366

[22] Filed: Jul. 8, 1999

[51] Int. Cl.[7] ..... A47K 1/04

[52] U.S. Cl. ..... 4/619; 4/639; 220/525; 312/228; 312/292; 312/405

[58] Field of Search ..... 4/619, 639, 580; 62/457.1, 457.2, 457.7; 312/405, 407, 228, 292; 220/4.12, 4.13, 524–526, DIG. 28

[56] References Cited

U.S. PATENT DOCUMENTS

| | | | |
|---|---|---|---|
| 245,295 | 8/1881 | Harrison, Jr. | 312/228 |
| 360,991 | 4/1887 | Brandt | 220/524 |
| 404,984 | 6/1889 | Robinson | 220/524 |
| 1,264,105 | 4/1918 | McGlauflin | 312/228 |
| 1,638,346 | 8/1927 | Levy | 4/580 |
| 2,760,207 | 8/1956 | Glintz | 4/159 |
| 3,667,648 | 6/1972 | Koziol | 312/292 |
| 4,236,771 | 12/1980 | Summers | 312/228 |
| 4,264,991 | 5/1981 | Lasalandra | 4/580 |
| 4,455,696 | 6/1984 | Assanah et al. | 4/584 |
| 5,337,911 | 8/1994 | Holub | 62/457.7 |
| 5,465,438 | 11/1995 | Allman et al. | 4/626 |
| 5,522,095 | 6/1996 | Faries, Jr. et al. | 4/639 |
| 5,526,539 | 6/1996 | Bower et al. | 4/516 |
| 5,671,611 | 9/1997 | Quigley | 62/457.7 |
| 5,678,255 | 10/1997 | Stoudamire, Sr. | 4/516 |

FOREIGN PATENT DOCUMENTS

| | | | |
|---|---|---|---|
| 5-51951 | 3/1993 | Japan | 4/619 |

*Primary Examiner*—Charles R. Eloshway
*Attorney, Agent, or Firm*—Henderson & Sturm LLP

[57] ABSTRACT

An insulated bed bath construction 10 including a thermally insulated dual reservoir basin member 20 which cooperates with a main lid member 30 having a pair of apertures 32, 33 which are alignable with the pair of liquid reservoirs 24, 25 and wherein each of the apertures 32, 33 is provided with a closure unit 13 adapted to sealingly engage the respective apertures 32, 33 to minimize thermal losses from one reservoir 24 when the other reservoir 25 is being accessed through its aligned aperture 33 during the bathing process.

5 Claims, 1 Drawing Sheet

INSULATED BED BATH CONSTRUCTION

BACKGROUND OF THE INVENTION

1. Field of the Invention

The present invention relates to the field of portable wash basins in general and in particular to an insulated bed bath construction designed primarily for hospital usage.

2. Description of Related Art

As can be seen by reference to the following U.S. Pat. Nos. 2,760,207; 4,455,696; 5,465,438; 5,526,539; and 5,678,255, the prior art is replete with myriad and diverse portable wash basins and the like.

While all of the aforementioned prior art constructions are more than adequate for the basic purpose and function for which they have been specifically designed, they are uniformly deficient with respect to their failure to provide a simple, efficient, and practical insulated, non-spill wash basin that while specifically designed for health care providers is also equally adaptable for other cleaning or washing tasks.

As most health care providers are all too well aware, the task of bathing bed ridden patients is often complicated by the rapid cooling of the liquid contents of the wash basins as well as spillage from the basin reservoirs.

As a consequence of the foregoing situation, there has existed a longstanding need for a new and improved insulated bed bath construction which employs dual insulated liquid reservoirs with independent closure elements incorporated into a novel lid member; and, the provision of such a construction is the stated objective of the present invention.

BRIEF SUMMARY OF THE INVENTION

Briefly stated, the insulated bed bath construction that forms the basis of the present invention comprises in general an insulated basin unit and a main lid unit provided with a plurality of closure units.

As will be explained in greater detail further on in the specification, the insulated basin unit includes a dual reservoir basin member having an insulated floor panel, insulated sidewalls, and an insulated divider panel that define two distinct insulated reservoirs; wherein, the floor panel is provided with a non-skid surface to minimize any sliding motion of the basin member that might cause the contents of the reservoirs to spill during use.

In addition, the main lid unit includes an insulated lid member which is adapted to sealingly engage the top of the dual reservoir basin member; wherein, the main lid member is further provided with a pair of enlarged access openings; wherein each of the access openings are positioned over one of the dual reservoirs.

Furthermore, each of the access openings are controlled by one of the pair of closure units wherein each closure unit includes a closure panel member which is slidably disposed in the main lid member to preserve the temperature levels of the liquid in the respective reservoirs during the transport to a desired location and during the washing process when only one liquid reservoir is being utilized at any given time.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
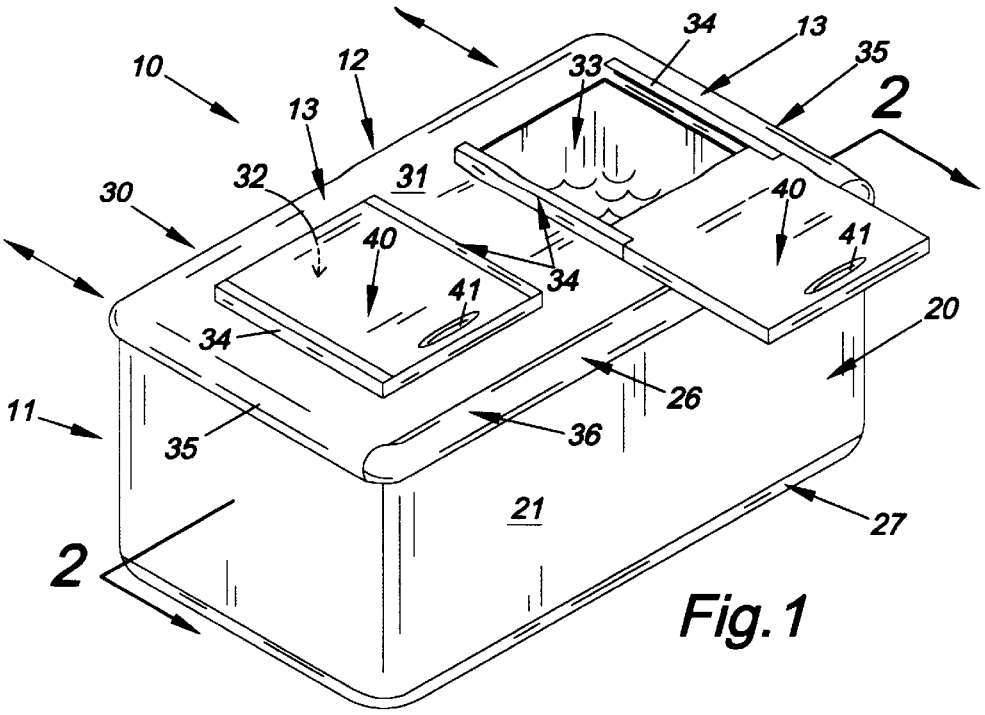
FIG. 1 is a perspective view of one version of the preferred embodiment of the bed bath construction that forms the basis of the present invention.

As can be seen by reference to the drawings, and in particular to FIG. 1, the bed bath construction that forms the basis of the present invention is designated generally by the reference number 10. The construction 10 comprises in general a basin unit 11, a main lid unit 12, and a pair of closure units 13 slidably disposed on the main lid unit 12. These units will now be described in seriatim fashion.

Figure 2:
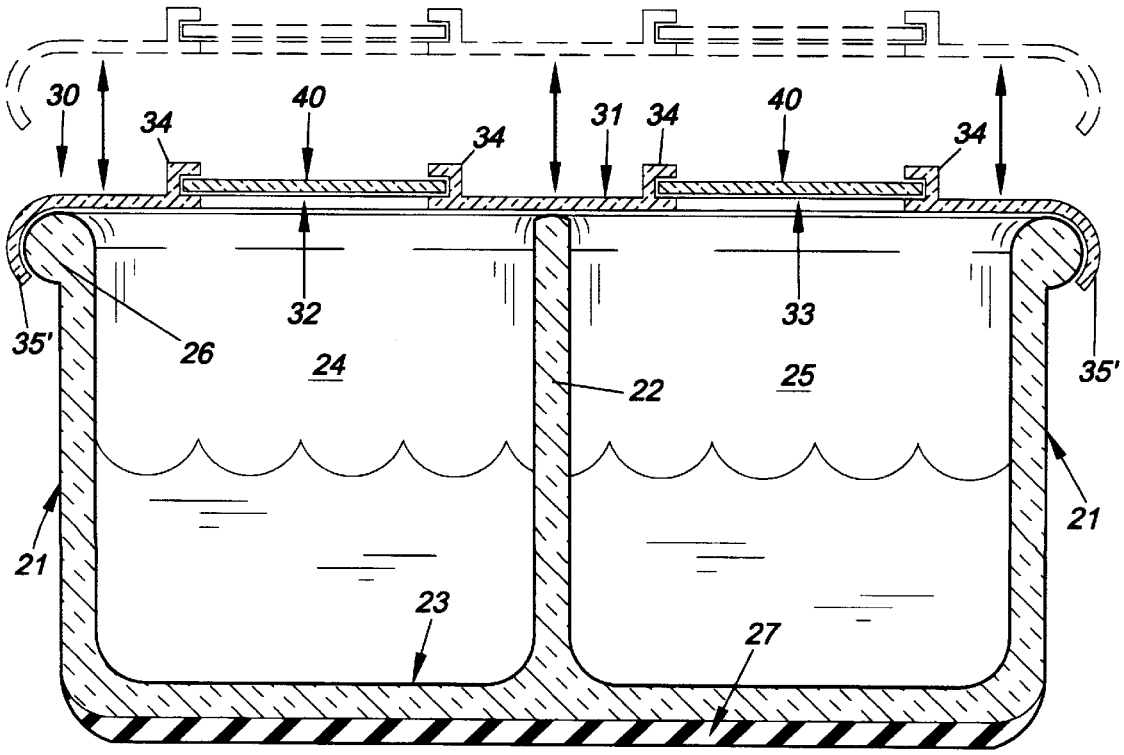
FIG. 2 is a cross-sectional view of another version of the preferred embodiment.

As shown in FIGS. 1 and 2, the basin unit 11 comprises a dual reservoir basin member 20 having insulated sidewalls 21, and insulated divider panel 22, and an insulated floor panel 23, which define a pair of thermally insulated reservoirs 24, 25 wherein the top of the sidewalls 21 are provided with a peripheral beaded lip 26 whose purpose and function will be described in greater detail further on in the specification.

In addition, the exterior surface of the floor panel 23 is provided with a high coefficient of friction coating 27 which will tend to resist any lateral displacement of the basin member 20 to minimize any spillage from the reservoirs 24, 25.

In one version of the preferred embodiment illustrated in FIG. 1, it can be seen that the main lid unit 12 comprises a generally rectangular lid member 30 having a generally flat top surface 31 provided with a pair of enlarged apertures 32, 33 wherein each of the apertures 32, 33 are dimensioned to overlie and provide access to one of the insulated reservoirs 24, 25 in the basin member 20 when the lid member 30 is disposed in the closed position relative to the basin member 20.

In addition, the opposite sides of each of the apertures 32, 33 are provided with inwardly directed rail elements 34 which are dimensioned to slidably receive the pair of closure units 13 as will be described in greater detail further on in the specification.

Furthermore, in this version of the preferred embodiment, the outer periphery of the lid member 30 is provided with at least a pair of downwardly depending curved skirt elements 35 which are dimensioned to slidably receive the beaded lips 26 on opposite sides of the basin member 20 to sealingly engage the lid member 30 with the basin member 20 in a well recognized fashion.

Still referring to FIG. 1, it should be appreciated that in this version of the preferred embodiment, the downwardly depending skirt elements 35 may be disposed on three contiguous sides of the lid member 30 wherein the fourth side of the lid member 30 would define an opening 36 that would allow the lid member 30 to be laterally engaged with the top of the basin member 20.

In the second version of the preferred embodiment illustrated in FIG. 2, it can be appreciated that all four sides of the lid member are provided with downwardly depending resiliently deformable skirt elements 35' such that the lid member 30 can be engaged with the top of the basin member 20 in a snap-fit fashion.

Returning once more to FIGS. 1 and 2, it can be seen that in both versions of the preferred embodiment, the pair of closure units 13 each comprise a panel closure member 40 which is dimensioned to be slidably received in the guide rails 34 on the opposite sides of the individual apertures 32, 33 in the lid member 30; wherein, each closure member 40 is provided with a recessed finger grip portion 41 for facilitating the extension and retraction of the panel closure members 40 relative to the guide rails 34.

As was mentioned previously, these closure members 40 are provided to minimize any thermal losses from the liquid contents of the respective segregated reservoirs 24, 25 when only one of the reservoirs 24, 25 is being used at any given time.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. An insulated bed bath construction comprising:

a basin unit including an insulated basin member having an open top provided with a peripheral beaded lip and the interior of the basin member is provided with insulated side walls, an insulated floor panel and an insulated divider panel which cooperates with the insulated sidewalls and the floor panel of the basin member to create a pair of liquid reservoirs within the interior of the basin member;

a main lid unit including a generally rectangular lid member dimensioned to overlie the insulated basin member and provided with a plurality of downwardly depending skirt elements which are adapted to sealingly engage at least three sides of the peripheral beaded lip of the open top of the basin member wherein the lid member is provided with a pair of apertures alignable with the pair of liquid reservoirs in the basin member; and a pair of closure units operatively associated with the lid member and adapted to sealingly engage the pair of apertures in the lid member.

2. The construction as in claim 1 wherein the insulated floor panel has an exterior surface provided with a high coefficient of friction coating.

3. The construction as in claim 1 wherein each of the closure units comprises a slidable panel closure member.

4. The construction as in claim 1 wherein the lid member sealingly engages three sides of the top of the basin member in a slidable fashion.

5. The construction as in claim 1 wherein the lid member has a fourth skirt element, the skirt elements sealingly engaging all four sides of the top of the basin member in a snap fit fashion.

* * * * *